US010448744B2

(12) United States Patent
Phillips

(10) Patent No.: US 10,448,744 B2
(45) Date of Patent: Oct. 22, 2019

(54) CHAIR

(71) Applicant: LIFETIME PRODUCTS, INC., Clearfield, UT (US)

(72) Inventor: Gary Phillips, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 269 days.

(21) Appl. No.: 15/373,457

(22) Filed: Dec. 8, 2016

(65) Prior Publication Data

US 2017/0164746 A1 Jun. 15, 2017

Related U.S. Application Data

(60) Provisional application No. 62/265,340, filed on Dec. 9, 2015.

(51) Int. Cl.
*A47C 3/04* (2006.01)
*A47C 4/04* (2006.01)
(Continued)

(52) U.S. Cl.
CPC ..... *A47C 7/26* (2013.01); *A47C 4/04* (2013.01); *A47C 4/08* (2013.01); *A47C 4/14* (2013.01);
(Continued)

(58) Field of Classification Search
CPC ..... A47C 1/121; A47C 1/124; A47C 3/04; A47C 3/045; A47C 3/12; A47C 4/04;
(Continued)

(56) References Cited

U.S. PATENT DOCUMENTS 3,736,022 A 3/1973 Radke
3,987,507 A * 10/1976 Hall ..... A47C 7/18 5/653
(Continued)

FOREIGN PATENT DOCUMENTS

DE 4031629 C1 * 3/1992 ..... A47C 3/04

OTHER PUBLICATIONS

Examination Report from Australian Patent Application No. 2016366435 dated Aug. 22, 2018.
(Continued)

*Primary Examiner* — Ryan D Kwiecinski
(74) *Attorney, Agent, or Firm* — Maschoff Brennan

(57) ABSTRACT

A folding chair may include a frame that is configured to transition the folding chair between use and storage positions. A seat base may be pivotally coupled thereto at a first particular length from a front end and a receiving portion may be disposed in an upper surface. The receiving portion may include left and right lateral edges, front and rear longitudinal edges, and a depth. The padding material may be disposed in the receiving portion and may have a lateral dimension related to a distance between the front and the rear longitudinal edges, a longitudinal dimension related to a distance between the front and the rear longitudinal edges, and a thickness related to the depth. The padding layer may cover a majority of a top surface of the padding material and of the upper surface. The cover may retain the padding material and the padding layer relative to the seat base.

19 Claims, 10 Drawing Sheets

(51) Int. Cl.

| | |
|---|---|
| ***A47C 4/08*** | (2006.01) |
| ***A47C 4/14*** | (2006.01) |
| ***A47C 7/02*** | (2006.01) |
| ***A47C 7/26*** | (2006.01) |
| ***A47C 7/18*** | (2006.01) |
| ***A47C 7/16*** | (2006.01) |
| ***A47C 4/24*** | (2006.01) |
| ***A47C 7/14*** | (2006.01) |

(52) U.S. Cl.
CPC ..... *A47C 4/24* (2013.01); *A47C 7/029* (2018.08); *A47C 7/14* (2013.01); *A47C 7/16* (2013.01); *A47C 7/18* (2013.01); *A47C 7/185* (2013.01); *A47C 3/045* (2013.01)

(58) Field of Classification Search
CPC .... A47C 4/08; A47C 4/10; A47C 4/14; A47C 4/18; A47C 4/20; A47C 4/24; A47C 5/10; A47C 7/029; A47C 7/16; A47C 7/18; A47C 7/24; A47C 7/26
See application file for complete search history.

(56) References Cited

U.S. PATENT DOCUMENTS

| | | | | |
|---|---|---|---|---|
| 4,753,480 | A * | 6/1988 | Morell | A47C 27/148 297/452.27 |
| 5,106,161 | A | 4/1992 | Meiller | |
| 5,499,413 | A | 3/1996 | Van Hekken | |
| D443,429 | S | 6/2001 | Mower et al. | |
| D466,712 | S | 12/2002 | Haney et al. | |
| D472,064 | S | 3/2003 | Haney et al. | |
| D472,723 | S | 4/2003 | Haney et al. | |
| D472,745 | S | 4/2003 | Haney et al. | |
| D473,059 | S | 4/2003 | Haney et al. | |
| 6,543,842 | B2 | 4/2003 | Haney | |
| D477,470 | S | 7/2003 | Haney et al. | |
| D477,926 | S | 8/2003 | Haney et al. | |
| D477,939 | S | 8/2003 | Haney et al. | |
| D481,550 | S | 11/2003 | Astle | |
| D482,540 | S | 11/2003 | Ashby | |
| D482,543 | S | 11/2003 | Haney et al. | |
| 6,687,934 | B1 * | 2/2004 | Liao | A47C 7/029 5/654 |
| D489,192 | S | 5/2004 | Jin et al. | |
| D498,071 | S | 11/2004 | Ashby et al. | |
| 6,871,906 | B2 | 3/2005 | Haney | |
| D507,425 | S | 7/2005 | Ashby et al. | |
| D508,339 | S | 8/2005 | Astle | |
| 7,014,261 | B2 | 3/2006 | Haney | |
| 7,017,986 | B2 | 3/2006 | Degen et al. | |
| D519,292 | S | 4/2006 | Ashby | |
| D523,254 | S | 6/2006 | Nye et al. | |
| 7,108,330 | B2 | 9/2006 | Mizelle et al. | |
| 7,452,035 | B2 | 11/2008 | Astle et al. | |
| D655,932 | S | 3/2012 | Ashby et al. | |
| D667,649 | S | 9/2012 | Waite et al. | |
| D686,007 | S | 7/2013 | Johnson | |
| 8,721,003 | B2 | 5/2014 | Waite et al. | |
| D710,623 | S | 8/2014 | Peery et al. | |
| 2009/0058155 | A1 * | 3/2009 | Bartlmae | A47C 1/124 297/248 |
| 2012/0175918 | A1 | 7/2012 | Southwick et al. | |
| 2013/0009427 | A1 | 1/2013 | Johnson et al. | |
| 2014/0145480 | A1 | 5/2014 | Johnson et al. | |

OTHER PUBLICATIONS

International Preliminary Report on Patentability from PCT/US2016/065907, dated Jun. 12, 2018.
U.S. Appl. No. 62/319,184, filed Apr. 6, 2016, Phillips.
U.S. Appl. No. 14/598,812, filed Jan. 16, 2015, Winter, et al.
U.S. Appl. No. 29/484,894, filed Mar. 13, 2014, Peery, et al.
U.S. Appl. No. 14/089,461, filed Nov. 25, 2013, Johnson, et al.
International Search Report and Written Opinion from PCT/US2016/065907, dated Mar. 2, 2017.

* cited by examiner

CHAIR

CROSS-REFERENCE TO RELATED APPLICATION

This application claims priority to and the benefit of U.S. provisional patent application Ser. No. 62/265,340, filed on Dec. 9, 2015, which is incorporated by reference in its entirety.

BACKGROUND OF THE INVENTION

Field of the Invention

This application is generally directed towards furniture and, in particular, to chairs.

Description of Related Art

Conventional chairs typically include a chair seat and a backrest. The chair seat and backrest can be separate structures or part of a single structure. Most chairs are used by one person at a time. Chairs typically include legs to support the seat and backrest above a surface such as a floor. Chairs may be constructed from a wide variety of materials such as wood, metal, and molded plastic. Conventional chairs may have a wide variety of designs depending on factors such as intended use, ergonomics, and appearance. In addition, known chairs may have various functional considerations such as size, weight, durability, portability, and desired seating position.

Some known chairs may be stacked together to form an orderly group, which may facilitate transportation and storage. Conventional chairs may also be aligned to allow the chairs to be more conveniently transported and stored. Chairs that may be stacked together with other chairs may be referred to as "stacking chairs" or "stackable chairs" and these types of chairs are frequently used in assembly halls, banquet halls, convention centers, hotels, schools, churches, and other locations where large groups of people meet. When needed for seating, stackable chairs may be positioned in an assortment of configurations and arrangements. When the stackable chairs are no longer needed for seating, they may be stacked for easy transportation and/or storage.

Folding chairs are also known and most folding chairs are lightweight, portable chairs that can be folded into a collapsed position. Folding chairs are generally used for seating in areas where permanent seating is not possible or practical. Folding chairs may be used during outdoor or indoor events such as performances, presentations and sporting events. Folding chairs may also be used in the home when extra seating is required for parties, card games, and temporary seating for guests.

Traditional folding chairs include folding chair legs that can pivot between folded or collapsed positions and unfolded or open positions. Disadvantageously, some known folding chairs are not very sturdy, strong, durable or well-made. In addition, some known folding chairs are difficult to use and may be challenging to secure in the use or collapsed positions. These problems may be especially difficult for chairs that are lightweight and comparatively inexpensive.

Conventional folding chairs also may not be able to support a large amount of weight or force. Further, conventional folding chairs may be rather time-consuming to manufacture and assemble. For example, known folding chairs may include a number of discrete parts that must be carefully assembled, which can undesirably increase the time required to manufacture the chairs.

Folding chairs are often stored in the collapsed position in a stack or row. While traditional folding chairs may save a significant amount of space by allowing the collapsed chairs to be placed in a stack or row, these chairs may still require a considerable amount of space even in the collapsed position. This may make it difficult, inconvenient, or impossible to store a number of chairs in an area of a particular size.

Chairs may include padding and/or may be constructed from relatively flexible materials, such as wicker, which may make the chair more comfortable to use, especially over long periods of time. Additionally, some chairs may include contoured chair seats and/or backrests for increased comfort of the user. Disadvantageously, flexible materials and contoured seats may undesirably increase costs and expenses. Moreover, features that increase comfort in conventional chairs often detract from functionality related to the use of the chair. For instance, use of flexible materials may reduce structural stability of the chair. Additionally, such features may increase overall dimensions of the chair, which may reduce functionality of the chair in the collapsed position.

BRIEF SUMMARY OF EMBODIMENTS OF THE INVENTION

A need therefore exists for a chair that eliminates the above-described disadvantages and problems.

One aspect is a folding chair that may include a backrest, a frame, a seat base, a padding material, a padding layer, and a cover. The frame may be connected to the backrest. The frame may include a right front leg, a left front leg, a right rear leg, and a left rear leg and may be configured to transition the folding chair from a use position to a storage position. When the folding chair is configured in the use position a lower portion of the right front leg and a lower portion of the right rear leg may form two sides of a generally equilateral triangle; an upper portion of the right front leg and an upper portion of the right rear leg may form two sides of a generally equilateral triangle, a lower portion of the left front leg and a lower portion of the left rear leg may form two sides of a generally equilateral triangle, and an upper portion of the left front leg and an upper portion of the left rear leg may form two sides of a generally equilateral triangle. The seat base may be pivotally coupled to the frame at a first length from a front end of the seat base. The seat base may include a left side, a right side, the front end, and a rear end. At least a portion of the seat base may define at least a portion of a receiving portion. For example, an upper portion of the seat base may define a receiving portion. The receiving portion may be integrally formed as part of a unitary, one-piece construction with the seat base. The receiving portion may have a left lateral edge, a right lateral edge, a front longitudinal edge, a rear longitudinal edge, and a depth. The left lateral edge may be oriented in a lateral direction and may be substantially parallel to the left side. The right lateral edge may be oriented in the lateral direction and may be substantially parallel to the right side. The front longitudinal edge may be oriented in a longitudinal direction and may be substantially parallel to the front end. The rear longitudinal edge may be oriented in the longitudinal direction and may be substantially parallel to the rear end. In detail, the receiving portion may be defined in about twenty-five percent (25%), about twenty percent (20%), about fifteen percent (15%), about ten percent (10%), about five percent (5%), or less of the upper surface of the seat base. The receiving portion may be positioned on the upper surface such that a first particular length approximately bisects the left lateral edge and the right lateral edge and a centerline of the seat base approximately bisects the front longitudinal edge and the rear longitudinal edge. The front longitudinal edge may be positioned at a second particular length from the front end. The second particular length may be about one-half a distance from the front end to the second end. The padding material may be disposed in the receiving portion. The padding material may have a lateral dimension that may be substantially equivalent to a distance between the front longitudinal edge and the rear longitudinal edge. The padding material may have a longitudinal dimension that may be substantially equivalent to a distance between the front longitudinal edge and the rear longitudinal edge. The padding material may have a thickness that may be substantially equivalent to the depth. The padding layer may cover at least a majority of a top surface of the padding material and at least a majority of the upper surface of the seat base. In detail, the padding layer may cover more than about eighty percent (80%) of the upper surface; more than eighty-five percent (85%) of the upper surface of the seat; or more than ninety percent (90%) of the upper surface of the seat. The cover may wrap at least partially around the seat base, the padding material, and/or the padding layer, and the cover may help retain the padding material and/or the padding layer relative to the seat base. The seat base and the backrest may be constructed blow-molded plastic. The seat base may include one or more of seat depressions in the upper surface in a first pattern and one or more receiving portion depressions in a receiving portion surface of the receiving portion in a second pattern. The second pattern may be substantially similar to the first pattern. The seat base may include a central channel in the upper surface. The central channel may be oriented along a centerline of the seat base. The seat base may include one or more rib channels that may extend from an outer portion of the seat base to the central channel.

Another aspect is a chair that may include a seat base, a frame, a receiving portion, a padding material, a padding layer, a cover, a plurality of seat depressions, and a plurality of receiving portion depressions. The seat base may be constructed blow-molded plastic. The seat base may include an upper surface, a left side, a right side, a front end, and a rear end. The frame may be connected to the seat base. The frame may be coupled to the seat base at a first particular length from the front side. The receiving portion may be defined in the upper surface of the seat base. The receiving portion may be integrally formed as part of a unitary, one-piece construction with the seat base. The receiving portion may include a left lateral edge, a right lateral edge, a front longitudinal edge, and a rear longitudinal edge. The left lateral edge may be at least substantially parallel to the left side. The right lateral edge may be at least substantially parallel to the right side. The front longitudinal edge may be at least substantially parallel to the front end. The rear longitudinal edge may be at least substantially parallel to the rear end. The front longitudinal edge may be positioned at a second particular length from the front end. The second particular length may be about one-half a distance from the front end to the second end. The receiving portion may be positioned on the upper surface such that the first particular length falls within the left lateral edge and the right lateral edge and a centerline of the seat base approximately bisects the front longitudinal edge and the rear longitudinal edge. The padding material may be disposed in the receiving portion. In detail, the receiving portion may be disposed in less than twenty percent (20%) of the upper surface and the padding layer may cover more than eighty percent (80%) of the upper surface. The receiving portion may be disposed in less than fifteen percent (15%) of the upper surface and the padding layer may cover more than eighty-five percent (85%) of the upper surface of the seat. The receiving portion may be disposed in less than ten percent (10%) of the upper surface and the padding layer may cover more than ninety percent (90%) of the upper surface of the seat. The receiving portion may be disposed in less than twenty percent (20%) of the upper surface and the padding layer may cover more than ninety percent (90%) of the upper surface of the seat. The receiving portion may be disposed in less than fifteen percent (15%) of the upper surface and the padding layer may cover more than ninety percent (90%) of the upper surface. The receiving portion may be disposed in less than ten percent (10%) of the upper surface and the padding layer may cover more than ninety percent (90%) of the upper surface. A depth of the receiving portion may be substantially equivalent to a thickness of the padding material such that when the padding material may be disposed in the receiving portion, a top surface of the padding material may be generally aligned with the upper surface of the seat base. The padding layer may cover at least a majority of a top surface of the padding material and at least a majority of the upper surface of the seat base. The cover may wrap at least partially around the seat base, the padding material, and the padding layer, to retain the padding material and the padding layer relative to the seat base. The plurality of seat depressions may be in the upper surface in a first pattern. The plurality of receiving portion depressions may be defined in a receiving portion surface of the receiving portion in a second pattern. The second pattern may be at least substantially similar to the first pattern. The upper surface may include an area in which one or more seat depressions are omitted from the first pattern in which the plurality of seat depressions may be arranged.

Yet another aspect is a seat base that may be constructed of molded plastic such as blow-molded plastic. The seat base may include an upper surface, a receiving portion, a plurality of seat depressions, a plurality of receiving portion depressions, a central channel, and one or more rib channels. The upper surface may be defined between a left side, a right side, a front end, and a rear end. The receiving portion may be integrally formed as part of a unitary, one-piece construction in the upper surface. The receiving portion may have a left lateral edge, a right lateral edge, a front longitudinal edge, a rear longitudinal edge, and a depth. The left lateral edge may be oriented in the direction and may beat least substantially parallel to the left side. The right lateral edge may be oriented in the direction and may be at least substantially parallel to the right side. The front longitudinal edge may be oriented in the direction and may be at least substantially parallel to the front end. The rear longitudinal edge may be oriented in the direction and may be at least substantially parallel to the rear end. In detail, the receiving portion may be defined in about twenty-five percent (25%), about twenty percent (20%), about fifteen percent (15%), about ten percent (10%), about five percent (5%), or less of the upper surface. The at least some of the plurality of seat depressions may be defined in the upper surface in a first pattern. The at least some of the plurality of receiving portion depressions may be defined in a receiving portion surface of the receiving portion in a second pattern. The central channel may be disposed in the upper surface. The central channel may be oriented along a centerline of the seat base. The one or more rib channels may be disposed in the upper surface. The one or more rib channels may extend from an outer portion of the seat base to the central channel.

In detail, the seat base may be configured to be pivotally coupled to a frame at a first particular length from the front side. The receiving portion may be positioned on the upper surface such that the first particular length may fall within the left lateral edge and the right lateral edge, a centerline of the seat base may approximately bisect the front longitudinal edge and the rear longitudinal edge, the front longitudinal edge may be positioned at a second particular length from the front end; and the second particular length may be about one-half a distance from the front end to the second end.

Advantageously, if the chair seat includes a receiving portion and a first layer of padding is disposed in the receiving portion, this portion of the chair may have a first set of characteristics. If the chair seat includes a second layer of padding, then the other portions of the chair seat may have a second set of characteristics. These different characteristics may create a more comfortable chair. For example, the portion of the chair with two layers of padding may provide increased comfort by providing increased cushioning and/or support to pressure points of the user. The two layers of padding may also reduce stress concentrations and/or stress points of the user. The two layers of padding may further reduce forces on the user, such as shear or torsion, which may increase the comfort of the user. If desired, the two layers of padding may be designed to support specific portions of a user.

These and other aspects, features, and advantages of the present invention will become more fully apparent from the following brief description of the drawings, the drawings, the detailed description of exemplary embodiments, and appended claims.

BRIEF DESCRIPTION OF THE DRAWINGS

The appended drawings contain figures of exemplary embodiments to further illustrate and clarify the above and other aspects, advantages, and features of the present invention. It will be appreciated that these drawings depict only exemplary embodiments of the invention and are not intended to limit its scope. Additionally, it will be appreciated that while the drawings may illustrate exemplary sizes, scales, relationships, and configurations of the invention, the drawings are not intended to limit the scope of the claimed invention. The invention will be described and explained with additional specificity and detail through the use of the accompanying drawings in which:

DETAILED DESCRIPTION OF SOME EXEMPLARY EMBODIMENTS

The present invention is generally directed towards chairs. The principles of the present invention, however, are not limited to chairs. It will be understood that, in light of the present disclosure, the chairs disclosed herein may have a variety of shapes, sizes, configurations, and arrangements. It will also be understood that chairs may include any suitable number and combination of features, components, aspects, and the like. In addition, while the chairs shown in the accompanying figures are illustrated as having particular styles, it will be appreciated the chairs may have any suitable style or configuration. Further, the chairs disclosed herein may be successfully used in connection with other types of objects and devices.

Additionally, to assist in the description of various exemplary embodiments of the chairs, words such as top, bottom, front, rear, sides, right, and left are used to describe the accompanying figures which may be, but are not necessarily, drawn to scale. It will further be appreciated that the chairs may be disposed in a variety of desired positions or orientations, and used in numerous locations, environments, and arrangements. A detailed description of exemplary embodiments of the chairs now follows.

Figure 1A:
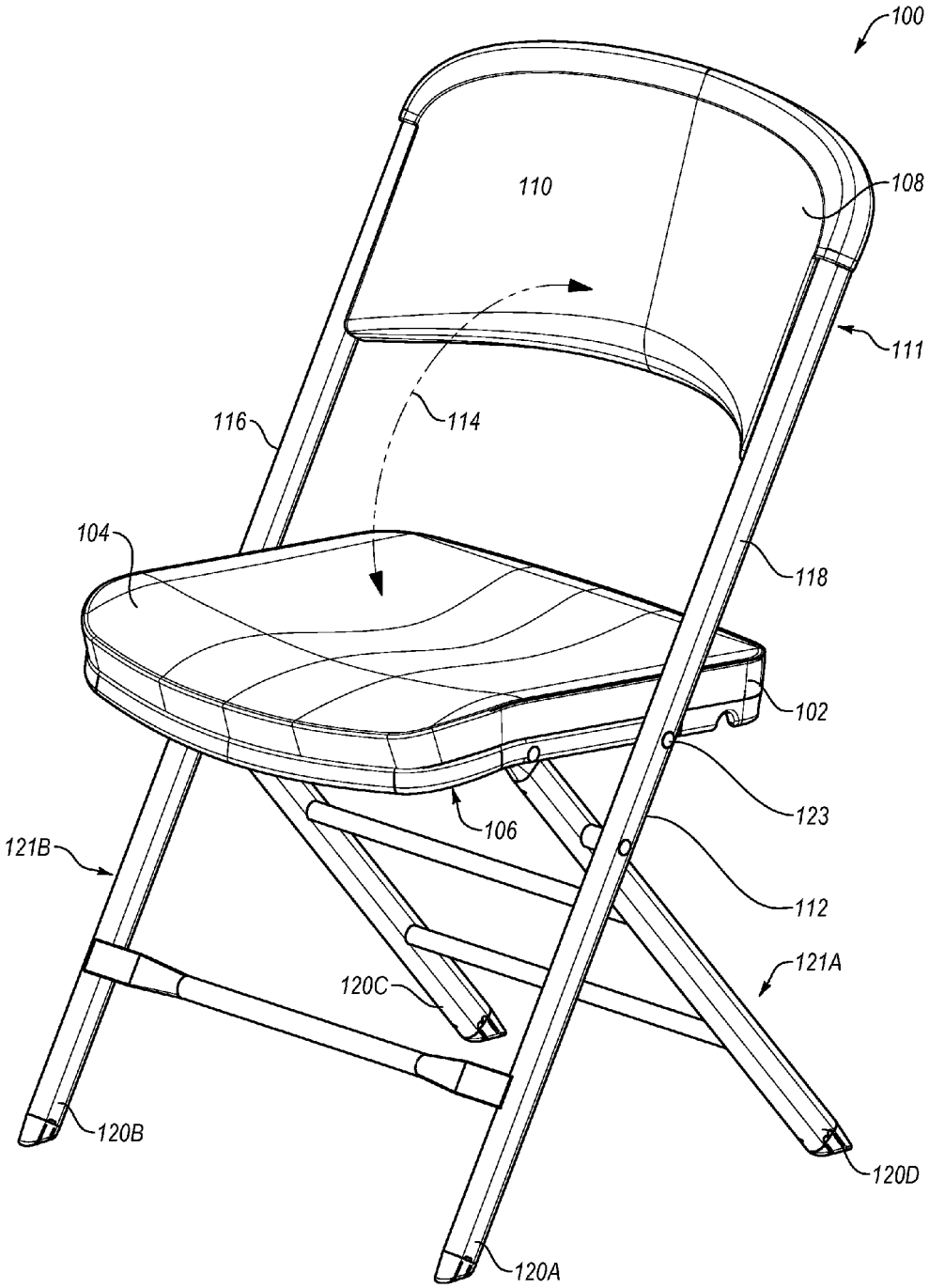
FIG. 1A is an upper perspective view of an exemplary chair.
Figure 1B:
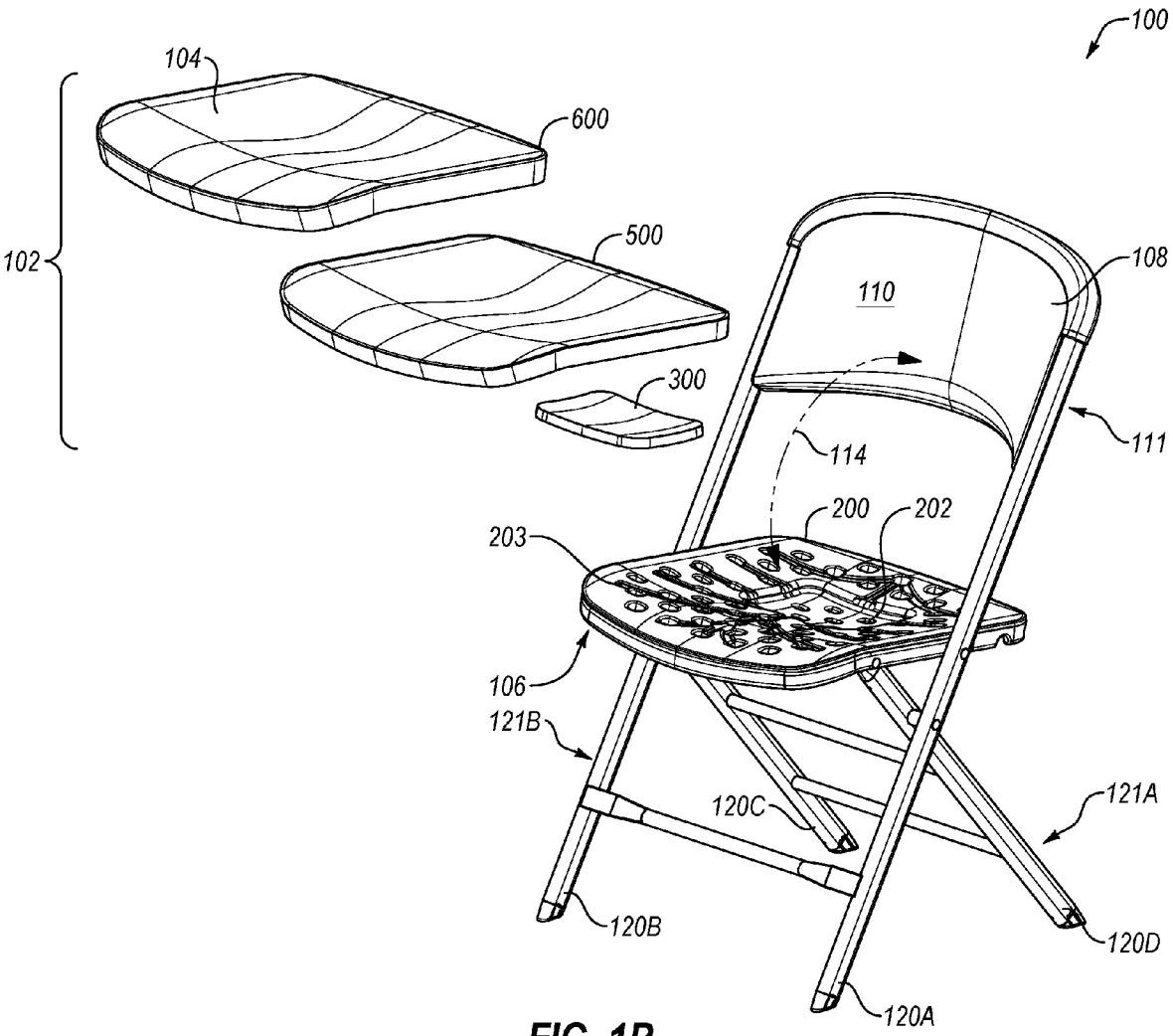
FIG. 1B is a partially exploded upper perspective view of the chair shown in FIG. 1A.

FIG. 1A is an upper perspective view of an exemplary chair 100 according to one or more embodiments of the invention. FIG. 1B is a partially exploded view of the chair 100. The chair 100 includes a seat 102 with a top surface 104 or portion and a lower surface 106 or portion. The lower surface 106 is generally opposite the top surface 104. The seat 102 may be a padded or a cushioned seat. The seat 102 may include one or more components (e.g., 200, 300, 500, and/or 500) that are configured to increase the comfort during use of the chair 100 as well as reduce costs and resources associated with construction of the seat 102.

For instance, some embodiments of the seat 102 may include a seat base 200 and the seat base may define at least a portion of defines a receiving portion 202. A padding material 300 may be positioned in the receiving portion 202 and a padding layer 500 may be positioned on an upper surface 204 of the seat base 200. A portion of the padding material 300, the padding layer 500, and/or the seat base 200 may be wrapped by a cover 600. Some additional details of the seat base 200, the receiving portion 202, the padding materials 300, and the cover 600 are described elsewhere in this disclosure.

The chair 100 may include chair back or backrest 108. The backrest 108 may include a front surface 110 or portion and a rear surface 111 or portion. The rear surface 111 is generally opposite the front surface 110. A frame 112 may connect the seat 102 to the backrest 108. The frame 112 may be used to support the seat 102 and the backrest 108 relative to a surface such as a floor on which the chair 100 is placed. The seat 102, backrest 108, and one or more features or components thereof may be separate components or integrally formed as part of a unitary, one-piece structure.

The frame 112 may include a left side portion 116 and a right side portion 118 that are connected to the seat 102 and/or the backrest 108. The frame 112 may also include or be attached to one or more supports or legs 120A-120D (generally, legs 120 or leg 120), which may be used to support the chair 100 above a surface such as a floor or the ground. An exemplary embodiment of the chair 100 may include a right front leg 120A, a left front leg 120B, a right rear leg 120D and a left rear leg 120C. The frame 112 may also include two leg assemblies 121A and 121B. For example, a first leg assembly 121A may include the right front leg 120A and the right rear leg 120D, and a second leg assembly 121B may include the left front leg 120B and the left rear leg 120C. After reviewing this disclosure, it will be appreciated that the chair 100 may include any suitable number and configuration of legs 120 depending, for example, upon the intended use and/or design of the chair 100.

One or more brackets 123 may be used to connect the legs 120, the frame 112, the seat 102, the backrest 108, or any combination thereof. For example, the bracket 123 may be attached to the seat 102 and one or more of the legs 120 may be attached to the bracket 123. For instance, the front legs 120A and 120B may be attached to the bracket 123 and the legs may be pivotally attached to the bracket 123. The bracket 123 may also connect the rear legs 120C and 120D to the seat 102. One of ordinary skill in the art, after reviewing this disclosure, will understand that the legs 120 may also be attached directly to the seat 102 or other suitable portions of the chair 100 depending, for example, upon the intended use of the chair 100. Moreover, the frame 112, the seat 102, backrest 108, the legs 120 or any combination thereof may also be connected by a friction, interference or snap fit connection, fasteners, connectors, or other suitable means.

The chair 100 may be a folding chair that is movable between folded or collapsed positions and unfolded or use positions. The use position is illustrated in FIGS. 1A and 1B. Accordingly, the legs 120 may be pivotally connected to the seat 102. For example, the chair 100 may include legs 120 that are pivotally connected at least proximate a midpoint of the legs 120. In particular, the right front leg 120A may be pivotally connected to the right rear leg 120D, and the left front leg 120B may be pivotally connected to the left rear leg 120C.

When the chair 100 is configured in the use position, a lower portion of the right front leg 120A and a lower portion of the right rear leg 120D may form two sides of a generally equilateral triangle and/or an upper portion of the right front leg 120A and an upper portion of the right rear leg 120D may form two sides of a generally equilateral triangle. Further, when the chair 100 is in the unfolded position, a lower portion of the left front leg 120B and a lower portion of the left rear leg 120C may form two sides of a generally equilateral triangle and/or an upper portion of the left front leg 120B and an upper portion of the left rear leg 120C may form two sides of a generally equilateral triangle.

The frame 112 may be configured to transition the chair 100 from a use configuration, which is depicted in FIGS. 1A and 1B, to a storage configuration. In the use configuration, the seat 102 may be positioned substantially parallel to a surface on which the chair 100 is placed and the backrest 108 may be positioned at an angle 114 relative to the seat 102. In some embodiments, the angle 114 may be about 90 degrees, between about 90 degrees and 110 degrees, between about 90 degrees and about 120 degrees, between about 90 degrees and 130 degrees, between about 90 degrees and about 140 degrees, or another angle as determined by the comfort of a user or upon the intended use of the chair 100.

In the use configuration, a user may sit on the chair 100 such that the back or portion thereof of the user contacts a portion of the front surface 110 of the backrest 108 and the buttocks or a portion thereof of the user may contact the top surface 104 of the seat 102. When seated on the chair 100, the user may be subject to pressure points, which may cause discomfort to the user. The receiving portion 202 may be disposed to help alleviate one or more pressure points. Some portion of the padding material 300, for example, may be positioned at least partially in the receiving portion 202. The padding material 300 may provide additional padding, which may decrease discomfort of the pressure points. Some additional details of the receiving portion 202 and the padding material 300 are described elsewhere in this disclosure.

Additionally, when seated on the chair 100, one or more portions of the user in contact with the seat 102 and/or the backrest 108 may get hot. One or more channels 203 may be disposed in the seat base 200 and the channels may be configured to increase ventilation or air circulation. The channels 203, for example, may provide additional air flow, which may increase ventilation. Some additional details of the channels 203 are described elsewhere in this disclosure.

The chair 100 may be sized and configured for use by a single person, but the chair may also be sized and configured to allow two or more persons to sit on the chair 100 at one time. It will be understood that the chair 100 may include a variety of suitable shapes, sizes and configurations, depending, for example, upon the intended use of the chair 100. For example, the chair 100 may be larger or smaller, and it may include other suitable designs depending, for example, upon its intended appearance, aesthetics, and the like.

At least a portion of the chair 100 may be constructed from molded or formed materials such as plastic. In particular, a portion of the chair 100 may be constructed from molded plastic, such as blow-molded or injection-molded plastic. For example, the seat 102, the backrest 108, or one or more portions or components thereof may be constructed from blow-molded plastic. One of ordinary skill in the art, in view of this disclosure, will appreciate that any suitable portion or portions of the chair 100 can be constructed from plastic and, for example, the chair 100 in its entirety may be constructed from plastic. In addition, one of ordinary skill in the art will appreciate that the seat 102 and the backrest 108 may be integrally formed as part of a unitary, one-piece structure. Thus, for example, the seat 102 and the backrest 108 may be constructed from blow-molded plastic, and the seat 102 and backrest 108 may be integrally formed as part of a unitary, one-piece structure.

In greater detail, the seat 102 or a component thereof may be constructed from plastic that is molded into the desired shape and configuration. Advantageously, the molded plastic seat 102 may allow a strong, durable and/or lightweight chair 100 to be quickly and efficiently manufactured. It will be appreciated that other suitable materials and processes may be used to construct the seat 102 and other portions of the chair 100. For example, the seat 102 or one or more components thereof may be constructed from wood, metal, etc. In addition, the seat 102 or one or more components thereof may be formed by various suitable methods or processes such as blow-molding, injection molding, extrusion molding, vacuum forming, tumble molding, and the like. It will also be appreciated that the seat 102 and backrest 108 are not required to be manufactured by the same process. For example, the seat 102 may be constructed from blow-molded plastic and the backrest 108 may be formed from vacuum or injection molded plastic.

Significantly, chairs (e.g., chair 100) including one or more components constructed from plastic may be quickly and efficiently manufactured. Chairs (e.g., chair 100) constructed from plastic may also be formed into many different desired shapes and sizes. Advantageously, chairs (e.g., chair 100) including one or more components constructed from plastic may be durable, lightweight, easily manufactured, and strong. It will be appreciated that any suitable portions of the chair may be constructed from plastic, and all or a portion of the chair may be constructed from other materials with appropriate properties and characteristics.

The legs 120 may be constructed, for example, from a strong and durable material such as metal and, in particular, steel. Construction of the legs 120 from steel may help create a strong and sturdy chair (e.g., the chair 100) that is able to support a significant amount of weight.

The frame 112 is desirably constructed from a relatively strong and sturdy material such as metal and, in particular, steel. In particular, the frame 112 may be constructed from hollow metal tubes or conduits that are bent or formed into the desired shapes and configurations. The frame 112 may have a generally circular, square, rectangular, oval or other suitable cross-sectional configuration. The metal frame 112 may allow a strong, sturdy, and lightweight chair 100 to be constructed. The frame 112 may also be constructed from other materials with appropriate characteristics and the frame 112 may have other suitable shapes and configurations. In particular, the size and shape of the frame 112 may depend, for example, upon the intended use of the chair 100. It will be appreciated that the chair 100 may also be constructed without the frame 112, if desired.

Although not shown in FIGS. 1A and 1B, the front surface 110 of the backrest 108 may include a padded or cushioned surface. The seat 102 is described in detail below. With the benefit of this disclosure, the description of the seat 102 or portions thereof may be applicable to the front surface 110 of the backrest 108.

Figure 2A:
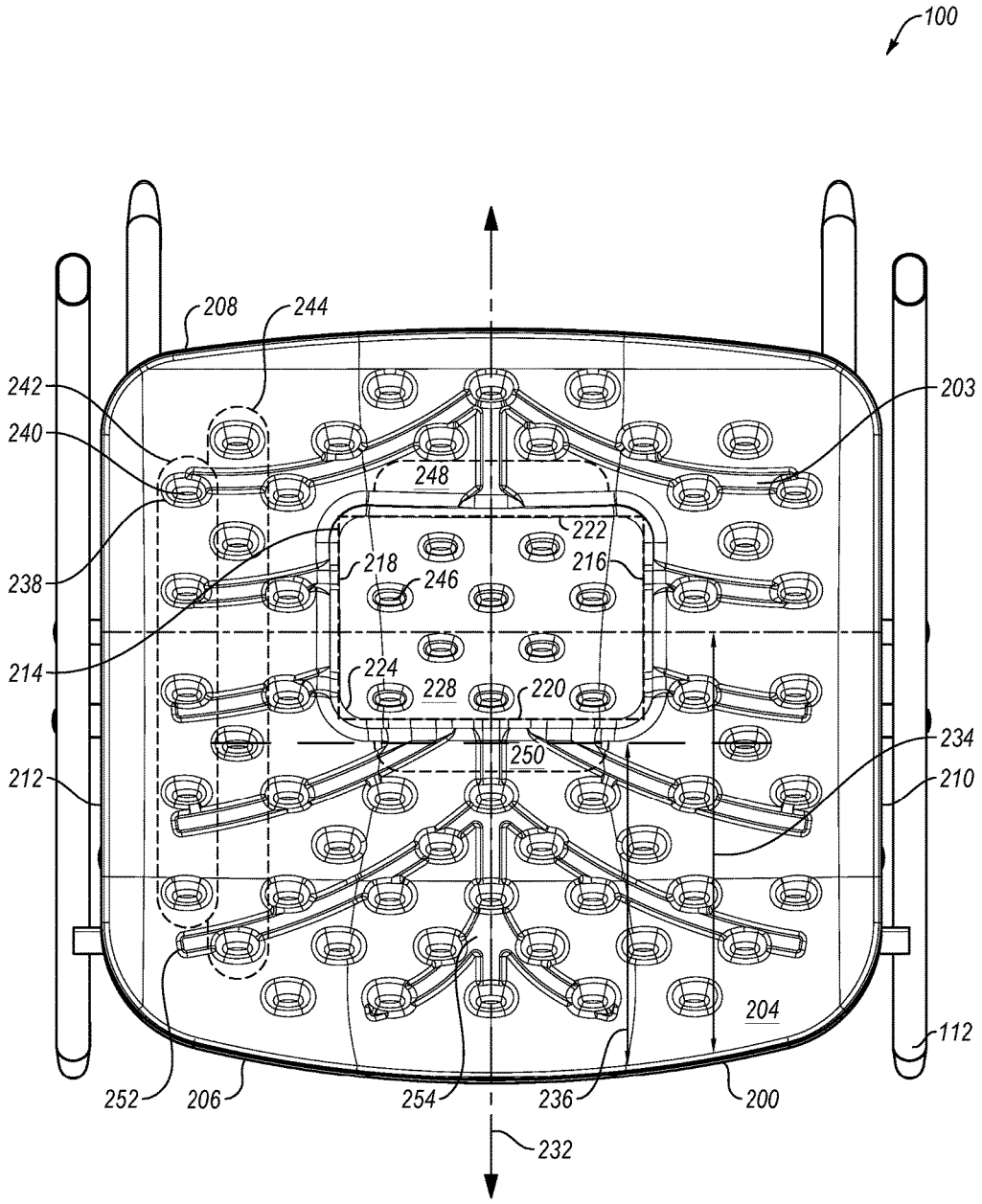
FIG. 2A is a top view of an exemplary seat base that may be implemented in connection with the chair shown in FIGS. 1A and 1B.
Figure 2B:
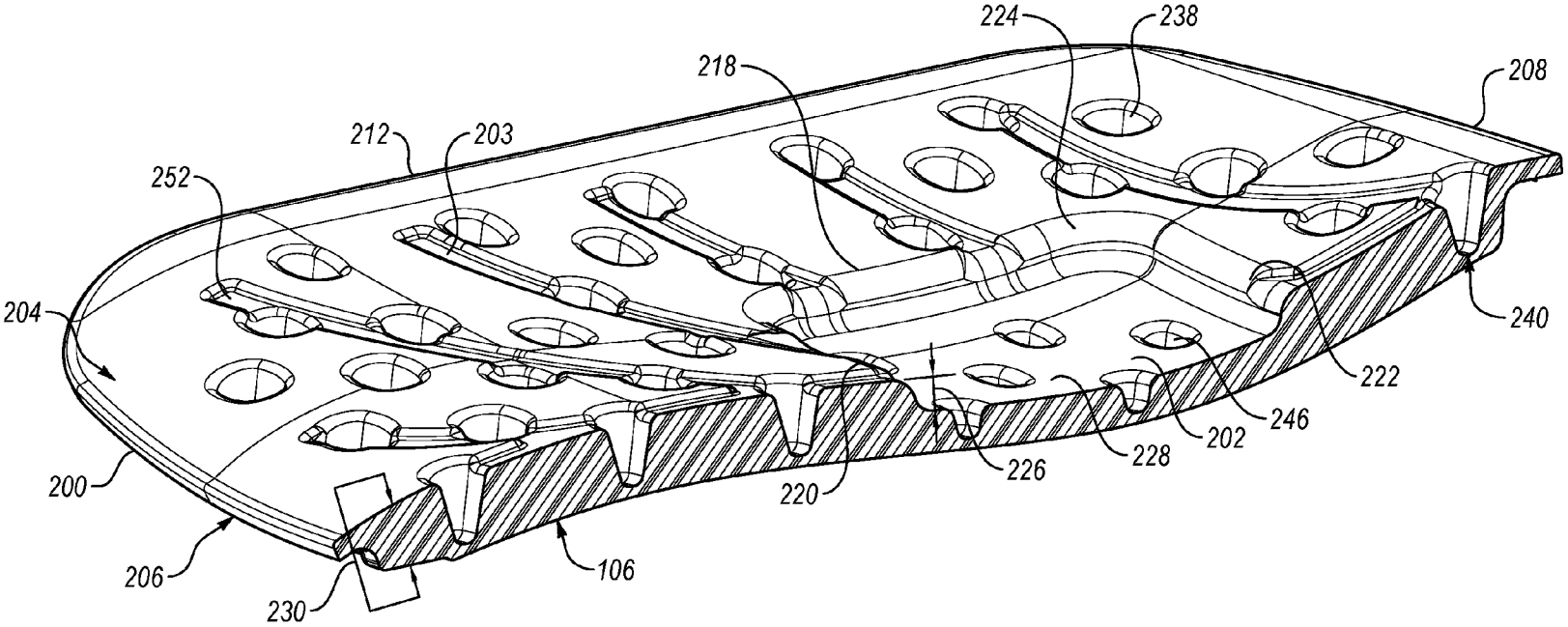
FIG. 2B is a perspective sectional view of the seat base shown in FIG. 2A.

FIG. 2A is a top view of an exemplary seat base 200 that may be implemented in the chair 100 of FIGS. 1A and 1B. In FIG. 2A, the seat base 200 is depicted with a portion of the frame 112. FIG. 2B is a perspective sectional view of the seat base 200 of FIG. 2A. The seat base 200 in FIGS. 2A and 2B includes the receiving portion 202 that is configured to receive padding material (300 of FIG. 1B). The receiving portion 202 may be sized and configured to receive the padding material and the receiving portion 202 may be specifically sized and located on the seat base 200 to support a portion of a user who is seated on the seat 102.

In particular, the received padding material may provide some additional cushion to a user or to the portion of the user during use. In greater detail, the receiving portion 202 may be specifically sized and located to provide cushioning to support only a desired portion of the user. The receiving portion 202 may also be specifically sized and located to provide increased comfort to the user. For example, the receiving portion 202 and the padding material may be sized, configured, and located to provide support at specific stress points, stress concentrations, or the like. The padding material may also provide increased comfort to the user by reducing forces (such as shear or torsion), increasing ventilation, increasing cooling, and the like.

The seat base 200 may include the upper surface 204. The upper surface 204 may extend from a front end 206 to a rear end 208 and from a right side 210 to a left side 212. The right side 210 and the left side 212 may extend from the front end 206 to the rear end 208. The upper surface 204 may include a contour. The receiving portion 202 may be defined in the upper surface 204 of the seat base 200. In particular, the receiving portion 202 may include a volume defined in the seat base 200 that is open to the upper surface 204.

The receiving portion 202 may include a perimeter 214. The perimeter 214 in the embodiment of FIGS. 2A and 2B is substantially rectangular. In other embodiments, the perimeter 214 may be oval, circular, triangular, hexagonal, pentagonal, or another suitable shape. One of ordinary skill in the art, after reviewing this disclosure, will appreciate that the receiving portion and/or chair seat may have other suitable shapes, sizes, configurations, and/or arrangements depending, for example, upon the intended use of the chair.

The perimeter 214 in the embodiment of FIGS. 2A and 2B may include a right lateral edge 216 and a left lateral edge 218. In addition, the perimeter 214 may include a front longitudinal edge 220 and a rear longitudinal edge 222. The right lateral edge 216 and the left lateral edge 218 may extend from the front longitudinal edge 220 to the rear longitudinal edge 222. The front longitudinal edge 220 may be substantially parallel to the rear longitudinal edge 222 or some portion thereof.

The perimeter 214 may include one or more rounded corners 224, only one of which is labeled in FIGS. 2A and 2B. The corners 224 may connect one or more of the longitudinal edges 220 or 222 with one or more of the lateral edges 216 and 218. In some embodiments, the perimeter 214 may include angled corners, which might include right angled corners, acute angled corners, or obtuse angled corners. The corners 224 may include two or more angles (e.g., two right angled corners and two obtuse angled corners) or may include one or more angled corners and one or more rounded corners.

The receiving portion 202 may include a depth 226 that is measured from the upper surface 204 to a receiving portion surface 228. The receiving portion surface 228 may be integrated with the upper surface 204 in the embodiment of FIGS. 2A and 2B. The receiving portions surface 228 may connect with the upper surface 204 via walls that extend from the perimeter 214 to the receiving portions surface 228. The depth 226 may be a portion of a base thickness 230 of the seat base 200 surrounding at least a portion of the perimeter 214 of the receiving portion 202. For example, the depth 226 may be between about ten percent (10%) and about thirty percent (30%) of the base thickness 230, between about thirty percent (30%) and about fifty percent (50%) of the base thickness 230, between about fifty percent (50%) and about sixty percent (60%) of the base thickness 230, between about sixty percent (60%) and about seventy percent (70%) of the base thickness 230, between about seventy percent (70%) and about eighty percent (80%) of the base thickness 230, between about eighty percent (80%) and about ninety percent (90%) of the base thickness 230, or another portion of the base thickness 230.

In the embodiment of FIGS. 2A and 2B, the right lateral edge 216 is oriented in the direction as the right side 210. In addition, the right lateral edge 216 may be substantially parallel to the right side 210 or a portion thereof. The left lateral edge 218 is oriented in the direction as the left side 212. The left lateral edge 218 may be substantially parallel to the left side 212 or some portion thereof. Similarly, the front longitudinal edge 220 and the rear longitudinal edge 222 may be oriented in the direction as the rear end 208. The front longitudinal edge 220 and/or the rear longitudinal edge 222 may be substantially parallel to the rear end 208 or some portion thereof.

The receiving portion 202 of FIGS. 2A and 2B may be positioned along a center line 232 of the seat base 200. For example, the center line 232 may bisect or approximately bisect the front longitudinal edge 220 and the rear longitudinal edge 222. Accordingly, the center line 232 of the seat base 200 may also be a center line of the receiving portion 202.

Additionally, the frame 112 may be coupled to the seat base 200 at a first particular length 234 from the front end 206. The receiving portion 202 may be positioned such that the first particular length 234 falls within the lateral edges 216 and 218. For example, in some embodiments, the receiving portion 202 may be positioned such that the first particular length 234 bisects or approximately bisects the lateral edges 216 and 218. In other embodiments, the receiving portion 202 may be positioned such that about one-third of the lateral edges 216 and 218 lie between the rear end 208 and the first particular length 234 and about two-thirds of the lateral edges 216 and 218 lie between the front end 206 and the first particular length 234. In yet other embodiments, the receiving portion 202 may be positioned such that two-thirds, one-fourth, one-fifth, two-fifths, or another fraction of the lateral edges 216 and 218 lie between the rear end 208 and the first particular length 234.

Positioning the receiving portion 202 at the first particular length 234 may situate the receiving portion 202 below a tailbone or another portion of a user who is sitting on a seat (e.g., 102 of FIGS. 1A and 1B) that includes the seat base 200. Accordingly, placement of a padding material in the receiving portion 202 may provide some comfort to the tailbone of the user.

In addition, the front longitudinal edge 220 may be positioned at a second particular length 236 from the front end 206. In the embodiment of FIGS. 2A and 2B, the second particular length 236 may be about one-half a distance from the front end 206 to the rear end 208. In other embodiments, the second particular length 236 from the front longitudinal edge 220 to the front end 206 may include another portion of the distance from the front end 206 to the rear end 208. For instance, the second particular length 236 may be between about twenty percent (20%) and about forty percent (40%), between about forty percent (40%) and about fifty percent (50%), between about fifty percent (50%) and about sixty percent (60%), between about sixty percent (60%) and about seventy percent (70%) of the distance from the front end 206 to the rear end 208, or another portion of the distance from the front end 206 to the rear end 208.

The receiving portion 202 may constitute some proportion of the upper surface 204. The proportion may depend on the size of the receiving portion 202 relative to the seat base 200. For instance, in some embodiments the receiving portion 202 may be configured to provide cushion to a relatively defined portion of a body of the user. Accordingly, in these embodiments, the receiving portion 202 may constitute a small proportion of the seat base 200. Quantifying the proportion may be based on an area of the receiving portion 202 relative to the upper surface 204 or may be based on a volume of the receiving portion 202 (e.g., a quantity necessary to fill the receiving portion 202) relative to a volume of the seat base 200. The perimeter 214 of the receiving portion 202 may define the area of the receiving portion 202. A proportion of the area of the receiving portion 202 to the upper surface 204 may be about twenty-five percent (25%), about twenty percent (20%), about fifteen percent (15%), about ten percent (10%), about five percent (5%), or less. Similarly, a proportion of the volume of the receiving portion 202 to the volume of the seat base 200 may be about twenty-five percent (25%), about twenty percent (20%), about fifteen percent (15%), about ten percent (10%), about five percent (5%), or less.

The seat base 200 may include one or more seat depressions 238. In FIGS. 2A and 2B, only one of the seat depressions 238 is labelled. The seat depressions 238 in the embodiment of FIGS. 2A and 2B are generally conical in shape with an opening defined in the upper surface 204. The bottom surface 240 may contact or be integral to a lower surface 106 of the seat base 200. The lower surface 106 may be spaced apart from the bottom surface 240. Thus, for example, a gap or space may be disposed between the bottom surface 240 and the lower surface of the seat base 200. In some embodiments, the seat depressions 238 may extend from the upper surface 204 to a bottom surface 240.

The seat depressions 238 may be arranged in a pattern in which the seat depressions 238 of a first column 242 are offset in a longitudinal direction from the seat depressions 238 in adjacent columns (e.g., 244). In other embodiments, the pattern may include the seat depressions 238 arranged in a grid pattern, a random pattern, a diagonal pattern or another suitable pattern. Additionally, the seat depressions 238 may include another shape such as cylindrical, rectangular, or spherical. Moreover, some embodiments of the seat base 200 may omit the seat depressions 238

In the embodiment of FIGS. 2A and 2B, one or more receiving portion depressions 246 may be disposed in the receiving portion surface 228 of the receiving portion 202. Only one of the receiving portion depressions 246 is labelled in FIGS. 2A and 2B. The lower surface 106 of the seat base 200 may be spaced apart from the receiving portion depressions 246 and/or the receiving portion surface 228. Thus, for example, a gap or space may be disposed between the receiving portion depressions 246 and/or the receiving portion surface 228 and the lower surface 106 of the seat base 200. In some embodiments, the receiving portion depressions 246 may extend towards and/or contact or engage the lower surface 106 of the seat base 200.

If desired, the receiving portion depressions 246 in the receiving portion surface 228 may be similar to seat depressions 238 formed in the upper surface 204. For instance, at least some of the receiving portion depressions 246 may be arranged in a pattern similar to the pattern of the seat depressions 238. Advantageously, the pattern of the receiving portion depressions 246 and the pattern of the seat depressions 238 may be at least generally or substantially the same. In addition, the seat depressions 238 and the receiving portion depressions 246 may have generally the same configuration and/or arrangements. This may help create a seat base with generally uniform properties and/or characteristics.

In some embodiments, the pattern of the seat depressions 238 may be interrupted by the receiving portion 202. For example, along the front and rear longitudinal edges 220 and 222, one or more seat depressions 238 may be omitted from the pattern. In FIG. 2A, two areas 248 and 250 may include portions of the upper surface 204 in which one or more of the seat depressions 238 are omitted. Advantageously, the omission of one or more seat depressions 238 may reduce complexity in the formation of the receiving portion 202 or may contribute to strength in the areas 248 and 250.

As shown in the accompanying figures, the seat base 200 may include the receiving portion 202 and the receiving portion may be integrally formed as part of a unitary, one-piece construction. Accordingly, the receiving portion 202 may be formed through one or more manufacturing processes described in this disclosure and the receiving portion may be concurrently or substantially concurrently with seat base 200. In addition, in some embodiments, the seat base 200 may be formed and the receiving portion 202 may be subsequently defined therein.

In the exemplary embodiment of FIGS. 2A and 2B, one or more channels 203 may be defined in the upper surface 204. The channels 203 may include a central channel 254 that is oriented along the centerline 232. The channels 203 may include multiple rib channels 252 and the rib channels may extend from outer portions of the seat base 200 to the central channel 254 or the receiving portion 202. All or a portion of the rib channels 252 may be generally arced or curved.

With reference to FIGS. 1B and 2A, the channels 252 and 254 may increase air circulation of the seat 102. For example, channels 252 and 254 may create a gap between the padding layer 500 and the upper surface 204 through which air can circulate.

In the embodiment of FIGS. 2A and 2B, the seat base 200 may include one receiving portion 202. It may be appreciated with the benefit of this disclosure that the seat base 200 may include more than one receiving portions 202. The more than one receiving portions 202 may be located at various locations on the upper surface 204, which may be determined by the function or intended use of the seat base 200.

Figure 3:
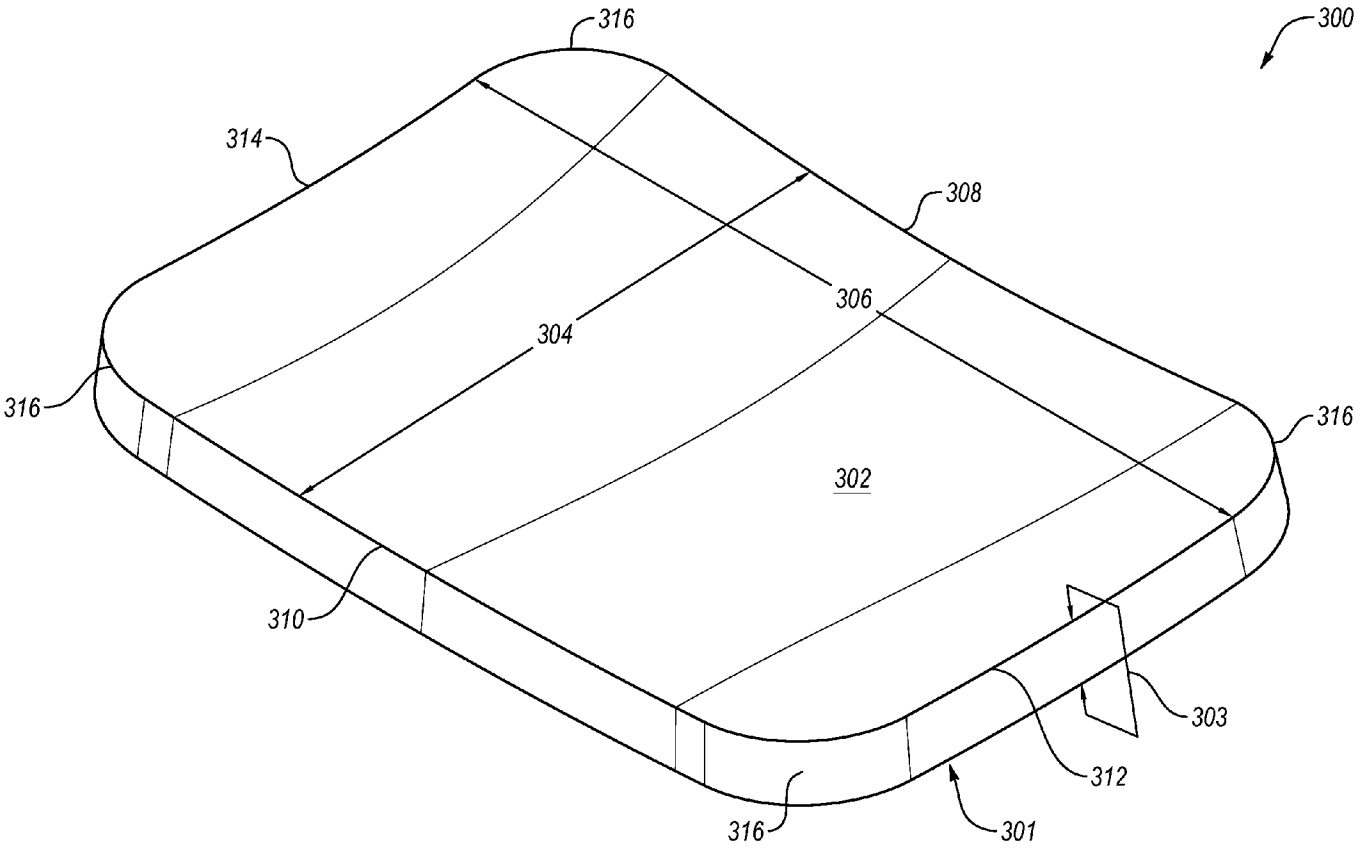
FIG. 3 is a perspective view of an exemplary padding material that may be implemented in connection with the chair shown in FIGS. 1A and 1B.

FIG. 3 is a perspective view of an exemplary padding material 300 that may be implemented in the chair 100 of FIGS. 1A and 1B. For example, the padding material 300 may be specifically sized and configured to be at least partially disposed in the receiving portion 202 of FIGS. 2A and 2B. The seat base 200 of FIGS. 2A and 2B may then be assembled in the seat 102 of the chair 100 of FIGS. 1A and 1B.

The padding material 300 may have specific characteristics or attributes such as density, cushioning, stability, and the like. The padding material 300 may be a layer of foam, such as open-cell foam, closed-cell foam, memory foam, and the like.

The padding material 300 of FIG. 3 may be sized to at least substantially fill a receiving portion (e.g., the receiving portion 202). In particular, the padding material 300 may include a top surface 302 that is opposite a bottom surface 301. A thickness 303 of the padding material 300 may be defined between the top surface 302 and the bottom surface 301. Additionally, the padding material 300 may include a lateral dimension 304 that is defined between a first end 308 and a second end 310. The padding material 300 may also include a longitudinal dimension 306 that is defined between a first side 312 and a second side 314. One or more corners 316 may connect the first or second end 308 or 310 to the first or second side 312 or 314. The corners 316 are rounded in the padding material 300 of FIG. 3. In other embodiments, the corners 316 may be angled (e.g., right, obtuse, acute) or chamfered.

With combined reference to FIGS. 2 and 3, the lateral dimension 304 of the padding material 300 may substantially correspond to a distance between the front longitudinal edge 220 and the rear longitudinal edge 222 of the receiving portion 202. For example, the lateral dimension 304 may be equal to or about equal to the distance between the front and the rear longitudinal edges 220 and 222. Alternatively, the lateral dimension 304 may be somewhat larger than the distance between the front and the rear longitudinal edges 220 and 222. For example, the lateral dimension 304 may be between about ten percent (10%) and about twenty percent (20%) larger than the distance between the front and the rear longitudinal edges 220 and 222.

The thickness 303 of the padding material 300 may substantially correspond to the depth 226 of the receiving portion 202. For example, the thickness 303 may be equal to or about equal to the depth 226. Alternatively, the thickness 303 may be somewhat larger than the depth 226. For example, the thickness may be between about ten percent (10%) and about twenty percent (20%) larger than the depth 226.

The longitudinal dimension 306 of the padding material 300 may substantially correspond to a distance between the right lateral edge 216 and the left lateral edge 218 of the receiving portion 202. For example, the longitudinal dimension 306 may be equal to or about equal to the distance between the right and the left lateral edges 216 and 218. Alternatively, the longitudinal dimension 306 may be somewhat larger than the distance between the right and the left lateral edges 216 and 218. For example, the longitudinal dimension 306 may be between about ten percent (10%) and about twenty percent (20%) larger than the distance between the right and the left lateral edges 216 and 218.

Accordingly, the top surface 302 of the padding material 300 may be generally aligned with the upper surface 204 of the seat base 200. The padding material 300 may also be slightly larger than the receiving portion 202 so that the padding material 300 is at least partially disposed in the receiving portion 202 by a friction engagement or an interference fit.

Figure 4A:
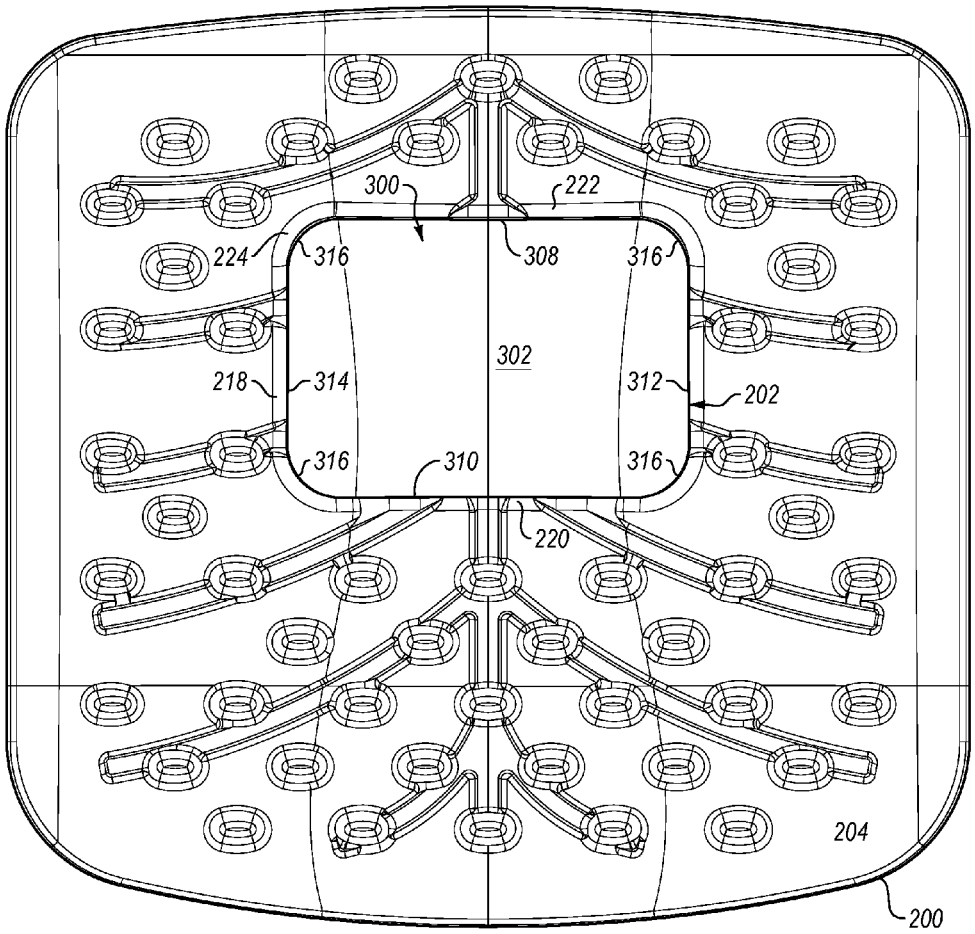
FIG. 4A is a top view of the padding material shown in FIG. 3 disposed in an exemplary receiving portion of the seat base shown in FIGS. 2A and 2B.
Figure 4B:
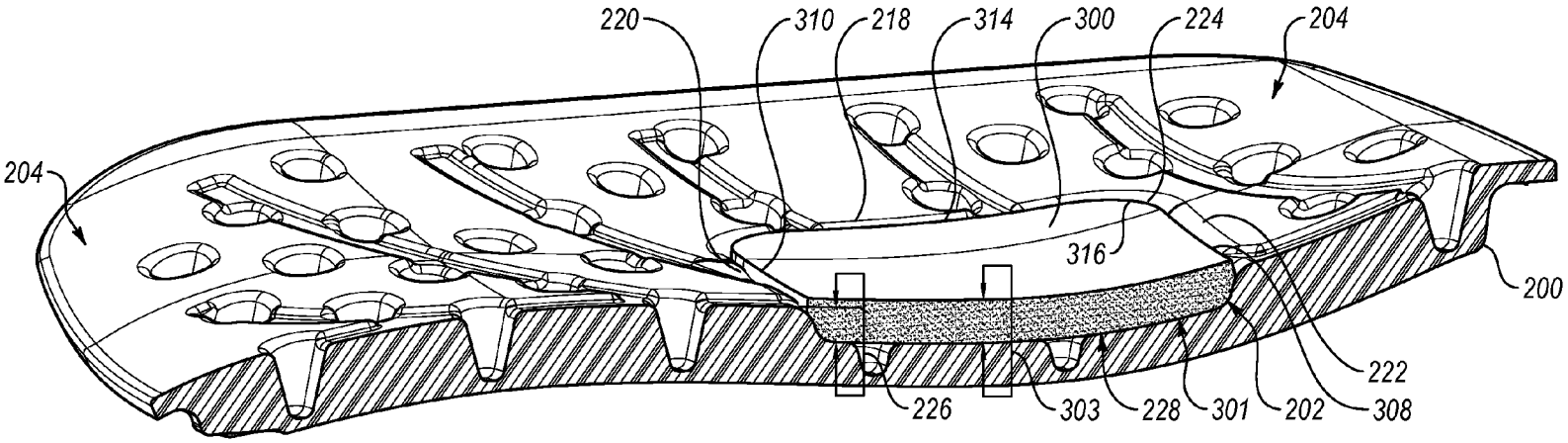
FIG. 4B is a perspective sectional view of the padding material of FIG. 3 disposed in an exemplary receiving portion of the seat base shown in FIGS. 2A and 2B.

FIG. 4A is a top view of the padding material 300 of FIG. 3 disposed in the receiving portion 202 of the seat base 200 of FIGS. 2A and 2B. FIG. 4B is a perspective sectional view of the padding material 300 of FIG. 3 disposed in the receiving portion 202 of the seat base 200 of FIGS. 2A and 2B.

With reference to FIG. 4B, when disposed in the receiving portion 202, the bottom surface 301 of the padding material 300 may contact the receiving portion surface 228 or portions thereof. In some embodiments, the padding material 300 may be press-fit into the receiving portion 202. In these and other embodiments, the padding material 300 may be retained in the receiving portion 202 through interference between the padding material and the receiving portion 202. In some embodiments, the bottom surface 301 may be adhered to the receiving portion surface 228.

As discussed above, the thickness 303 of the padding material 300 may be equal to the depth 226 of the receiving portion 202. Accordingly, the top surface 302 of the padding material 300 may be generally aligned with the upper surface 204 of the seat base 200 as depicted in FIGS. 4A and 4B. In other embodiments, the padding material 300 may be slightly larger than the receiving portion 202. Thus, the top surface 302 of the padding material 300 may extend above the upper surface 204. In yet other embodiments, the top surface 302 of the padding material 300 may be below the upper surface 204 of the seat base 200.

In addition, as depicted in FIGS. 4A and 4B, the left lateral edge 218 of the receiving portion 202 may contact the second side 314 of the padding material 300, the right lateral edge 216 of the receiving portion 202 may contact the first side 312 of the padding material 300, the front longitudinal edge 220 of the receiving portion 202 may contact the second end 310 of the padding material 300, the rear longitudinal edge 222 of the receiving portion 202 may contact the first end 308 of the padding material 300, the corners 224 of the receiving portion 202 may contact the corners 316 of the padding material 300, or any combination thereof. In other embodiments, there may be some distance or space between the one or more of the edges 216, 218, 220, and 222 of the receiving portion 202 and the padding material 300.

Figure 5:
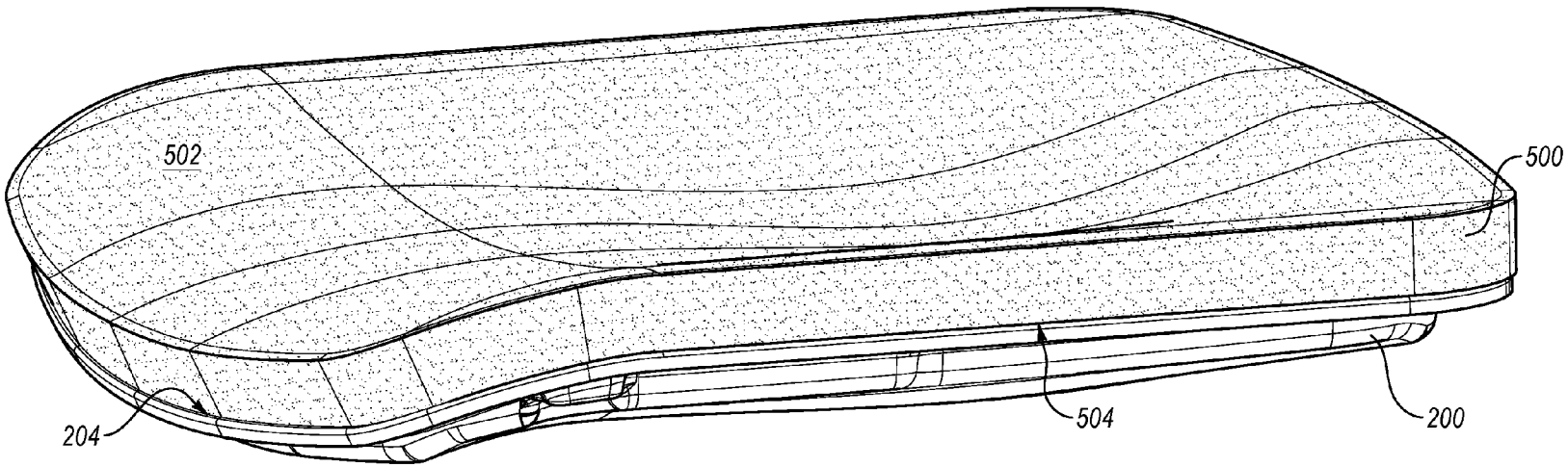
FIG. 5 is a perspective view of a padding layer that may be implemented in connection with the chair shown in FIG. 1.

FIG. 5 is a perspective view of a padding layer 500 that may be implemented in the chair 100 of FIG. 1. In FIG. 5, the padding layer 500 is illustrated as being positioned on the seat base 200. In particular, the padding layer 500 is illustrated as being positioned on the upper surface 204 of the seat base 200 or some portion thereof. In FIG. 5, the padding layer 500 is illustrated as being positioned on the upper surface 204 with the padding material 300 disposed in the receiving portion 202 as depicted in FIG. 4. Accordingly, the padding material 300 may be positioned between the padding layer 500 and the seat base 200.

The padding layer 500 may be configured to provide cushion over the upper surface 204 of the seat base 200 or a substantial portion thereof. The cushion provided by the padding layer 500 may be in addition to the cushion provided by the padding material 300 disposed in the receiving portion (e.g., receiving portion 202 described elsewhere in this disclosure). Thus, in the exemplary embodiment of FIG. 5, the chair 100 may include a first layer of padding that is the padding material 300 that is at least substantially disposed in the receiving portion 202 and a second layer of padding that is the padding layer 500 that covers at least a substantial portion of the upper surface 204 of the seat base 200. In other embodiments, the chair 100 may include more than one padding layer 500. For example, the chair 100 may include two, three, four, five, or more padding layers 500.

The padding layer 500 may include a top surface 502 that is opposite a bottom surface 504 of the padding layer 500. The bottom surface 504 is positioned on the upper surface 204 of the seat base 200. In some embodiments, the padding layer 500 may be adhered or affixed (e.g., via a glue) to the upper surface 204.

The padding layer 500 may cover at least a majority of the upper surface 204 of the seat base 200. For example, a padding layer 500 may cover all or substantially all of the upper surface 204 of the seat base 200. In an exemplary embodiment, the padding layer 500 may cover at least about one hundred percent (100%), about ninety-five percent (95%), about ninety percent (90%), about eighty-five percent (85%), about eighty percent (80%), about seventy-five percent (75%), or less of the upper surface 204 of the seat base 200.

The padding layer 500 may be a layer of foam, such as open-cell foam, closed-cell foam, memory foam, and the like. The padding layer 500 and the padding material 300 may be comprised of or may include the same material, may have similar characteristics, or may have different characteristics depending, for example, upon the intended use of the chair 100. In addition, while the accompanying figures illustrate the padding as layers of foam, one of ordinary skill in the art will appreciate after reviewing this disclosure that padding may be any materials with the desired properties and characteristics.

In FIGS. 3-5, the padding layer 500 and the padding material 300 are illustrated as two separate pieces of material. In other embodiments, the padding material 300 and the padding layer 500 may be combined in an integral padding structure. For example, the bottom surface 504 of the padding layer 500 may be joined with the top surface 302 of the padding material 300.

Figure 6A:
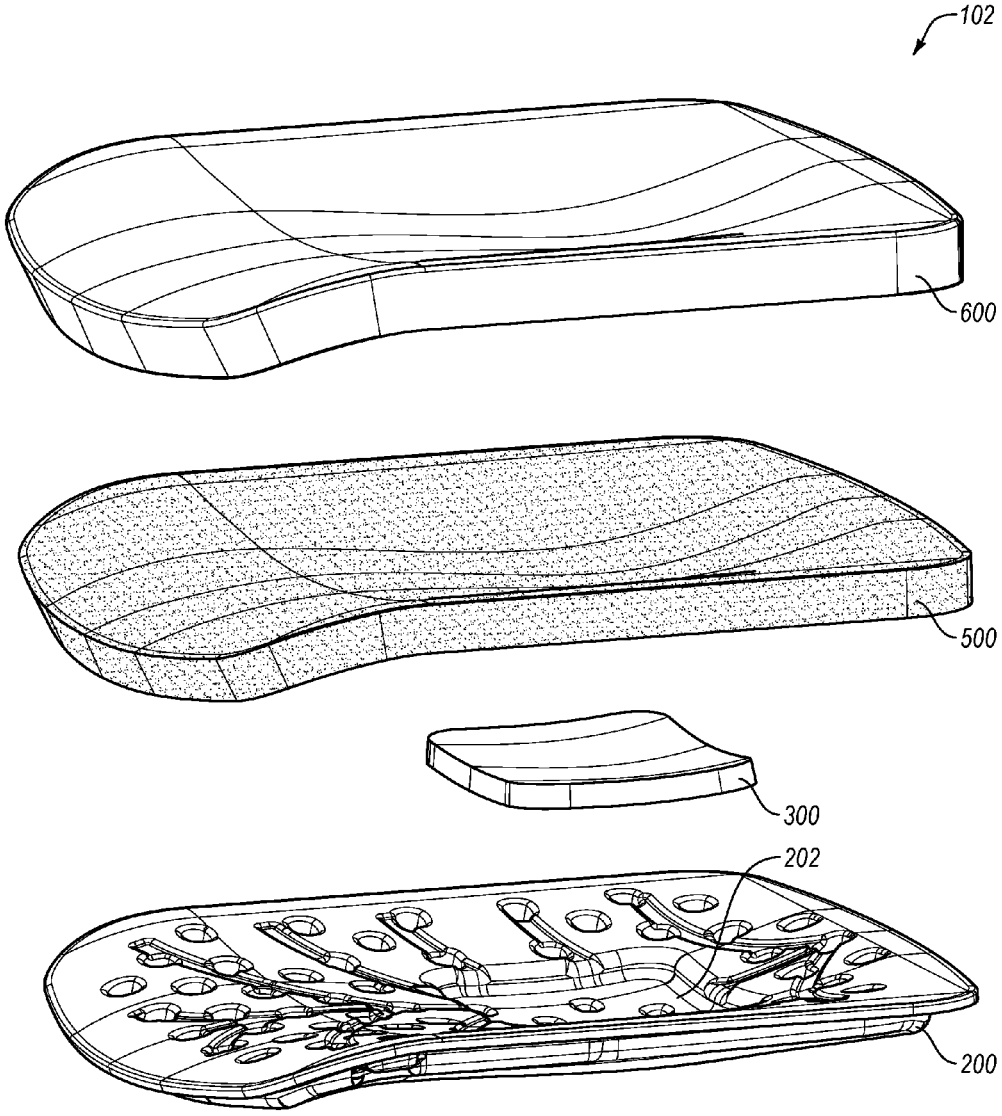
FIG. 6A is perspective exploded view of a portion of the chair shown in FIGS. 1A and 1B.
Figure 6B:
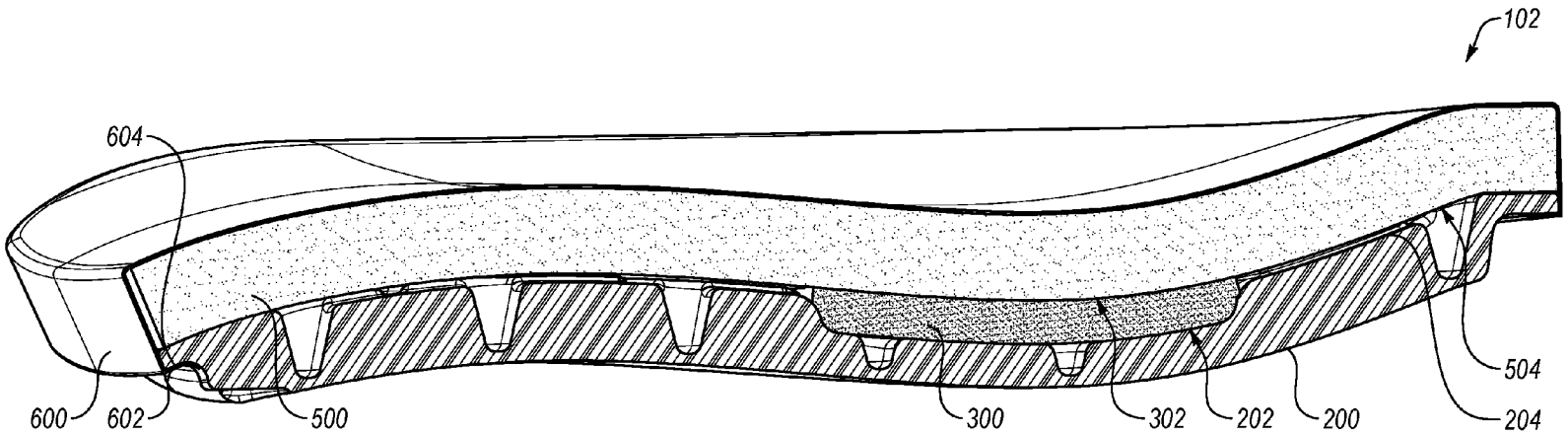
FIG. 6B is a perspective sectional view of a portion of the chair shown in FIGS. 1A and 1B.

FIG. 6A is a perspective exploded view of the chair 100 of FIGS. 1A and 1B. FIG. 6B is a perspective sectional view of the chair 100. The seat 102 depicted in FIGS. 6A and 6B includes a cover 600 that wraps at least a majority of the seat base 200, the padding material 300, and the padding layer 500. The cover 600 may retain the padding layer 500 and/or the padding material 300 relative to the seat base 200.

The cover 600 may be comprised of a fabric. The fabric may be elastic or may include some elastic properties. The cover 600 may accordingly enable some stretch such that the padding material 300 and/or the padding layer 500 are retained relative to the seat base 200 with some tension. In particular, as best depicted in FIG. 6B, a cover perimeter 602 of the cover 600 may wrap around a lip 604 that makes up an outer edge or a portion thereof of the seat base 200. The cover perimeter 602 may pull against the lip 604.

In FIG. 6A, the cover 600 is shown separated from the padding layer 500, which is shown separated from the padding material 300 and the seat base 200. FIG. 6B depicts the seat 102 in an assembled configuration. In the assembled configuration, the padding material 300 is disposed in the receiving portion 202. The padding material 300 may be disposed in the receiving portion 202 such that the bottom surface 301 of the padding material 300 contacts the receiving portion surface 228. The padding layer 500 may be positioned on at least a majority of the upper surface 204 of the seat base 200. For example, the padding layer 500 may be positioned on at least the majority of the upper surface 204 such that the bottom surface 504 of the padding layer 500 contacts the upper surface 204 and the top surface 302 of the padding material 300. Additionally, the cover 600 may be positioned over the padding layer 500 such that the padding layer 500 and the padding material 300 are positioned between the seat base 200 and the cover 600.

In the assembled configuration, an overall thickness of the seat 102 may be defined from the lower surface 106 to the top surface 104. The overall thickness may not be increased relative to conventional chairs. Thus, the seat 102 may provide additional cushion via the padding material 300 than conventional chairs. The seat 102 may also provide the additional cushion without increasing the overall thickness or with minimal increase in the overall thickness because the padding material 300 is disposed in the receiving portion 202.

With combined reference to FIGS. 1-6, advantageously, by specifically disposing the receiving portion 202 and the padding material 300 at a desired location, comfort of the user may increase. Thus, the seat 102 may include two layers of padding (e.g., the padding material 300 and the padding layer 500) at the desired location, which may increase the comfort of the user without substantially increasing price, overall seat thickness, and complexity of the seat 102. For instance, the limited size of the receiving portion 202 and/or accompanying padding (e.g., the padding material 300) may decrease costs because only a small amount of padding may be disposed in the receiving portion 202. Significantly, this may allow a more comfortable chair to be created and at a lower cost because extra padding may only be positioned in a limited area and the extra padding may be quickly and easily disposed in the receiving portion 202, which may decrease manufacturing costs. In addition, if the seat 102 is constructed from molded plastic, such as blow-molded plastic, the upper surface of the seat 102 may slightly give, bend, and/or deflect, which may also help create a more comfortable chair.

The receiving portion 202 may allow padding (e.g., the padding material 300) to be quickly and easily disposed in a desired position of the seat base 200. The receiving portion 202 may also not interfere with and/or allow the padding layer 500 to be quickly and easily attached to the seat base 200. The receiving portion 202 may allow less padding or cushioning to be used because more padding is used only in a desired, limited area. The receiving portion 202 may also allow less padding or cushioning to be used in other portions of the chair 100. For these and other reasons, a more comfortable chair may be constructed with generally the same or lower material, manufacturing, and/or assembly costs.

One of ordinary skill in the art will appreciate after reviewing this disclosure that the chair may have other suitable shapes, sizes, configurations, and arrangements depending, for example, upon the intended use of the chair. One of ordinary skill in the art will also appreciate that different components of the chair may have various shapes, sizes, configurations, and arrangements depending, for example, upon the intended use of the chair. Further, one of ordinary skill in the art will appreciate the chair may include any suitable number or combination of features or aspects.

Although this invention has been described in terms of certain exemplary embodiments, other embodiments apparent to those of ordinary skill in the art are also within the scope of this invention. Accordingly, the scope of the invention is intended to be defined only by the claims which follow.

What is claimed is:

1. A folding chair comprising:

a backrest;

a frame connected to the backrest, the frame including a right front leg, a left front leg, a right rear leg, and a left rear leg and configured to transition the folding chair from a use position to a storage position;

a seat base pivotally coupled to the frame at a first particular length from a front end of the seat base;

a receiving portion in an upper surface of the seat base having a left lateral edge, a right lateral edge, a front longitudinal edge, a rear longitudinal edge, and a depth;

a padding material disposed in the receiving portion, the padding material having a lateral dimension that corresponds to a distance between the front longitudinal edge and the rear longitudinal edge, a longitudinal dimension that corresponds to a distance between the front longitudinal edge and the rear longitudinal edge, and a thickness that corresponds to the depth such that the padding material is at least partially disposed in the receiving portion by a friction engagement or an interference fit;

a padding layer covering a majority of a top surface of the padding material and a majority of the upper surface of the seat base; and a cover enclosing at least a portion of the seat base, the padding material, and the padding layer, to retain the padding material and the padding layer relative to the seat base.

2. The folding chair as in claim 1, wherein the receiving portion is disposed in about twenty-five percent (25%), about twenty percent (20%), about fifteen percent (15%), about ten percent (10%), or about five percent (5%) of the upper surface of the seat base.

3. The folding chair as in claim 2, wherein the padding layer covers more than about eighty percent (80%) of the upper surface; more than eighty-five percent (85%) of the upper surface; or more than ninety percent (90%) of the upper surface.

4. The folding chair as in claim 1, wherein:

the seat base includes a left side, a right side, the front end, and a rear end;

the left lateral edge is oriented in a direction of the left side;

the right lateral edge is oriented in a direction of the right side;

the front longitudinal edge is oriented in a direction of the front end; and the rear longitudinal edge is oriented in a direction of the rear end.

5. The folding chair as in claim 4, wherein:

the receiving portion is positioned on the upper surface such that the first particular length approximately bisects the left lateral edge and the right lateral edge and a centerline of the seat base approximately bisects the front longitudinal edge and the rear longitudinal edge;

the front longitudinal edge is positioned at a second particular length from the front end; and the second particular length is about one-half a distance from the front end to a second end.

6. The folding chair as in claim 1, wherein the seat base comprises:

a plurality of seat depressions in the upper surface in a first pattern;

a plurality of receiving portion depressions in the receiving portion surface of the receiving portion in a second pattern, the second pattern being similar to the first pattern;

a central channel in the upper surface, the central channel being oriented along a centerline of the seat base; and one or more rib channels that extend from an outer portion of the seat base to the central channel.

7. The folding chair as in claim 1, wherein when configured in the use position:

a lower portion of the right front leg and a lower portion of the right rear leg form two sides of a triangle;

an upper portion of the right front leg and an upper portion of the right rear leg form two sides of a triangle;

a lower portion of the left front leg and a lower portion of the left rear leg form two sides of a triangle; and an upper portion of the left front leg and an upper portion of the left rear leg form two sides of a triangle.

8. The chair as in claim 1, wherein:

the seat base and the backrest are constructed of blow-molded plastic; and the receiving portion is integrally formed as part of a unitary, one-piece construction with the seat base.

9. A chair, comprising:

a seat base constructed of blow-molded plastic;

a receiving portion integrally formed as part of a unitary, one-piece construction with the seat base in an upper surface of the seat base, the receiving portion including a depth that is a portion of a base thickness of the seat base;

a padding material disposed in the receiving portion;

a padding layer covering a majority of a top surface of the padding material and a majority of the upper surface of the seat base;

a cover at least partially enclosing the seat base, the padding material, and the padding layer, to retain the padding material and the padding layer relative to the seat base; and a frame connected to the seat base.

10. The chair as in claim 9, wherein:

the receiving portion includes a left lateral edge, a right lateral edge, a front longitudinal edge, and a rear longitudinal edge;

the seat base includes a left side, a right side, a front end, and a rear end;

the left lateral edge is oriented in a direction of the left side;

the right lateral edge is oriented in a direction of the right side;

the front longitudinal edge is oriented in a direction of the front end; and the rear longitudinal edge is oriented in a direction of the rear end.

11. The chair as in claim 10, wherein:

the frame is coupled to the seat base at a first particular length from the front end; and the receiving portion is positioned on the upper surface such that the first particular length falls within the left lateral edge and the right lateral edge and a centerline of the seat base approximately bisects the front longitudinal edge and the rear longitudinal edge.

12. The chair of claim 10, wherein:

the front longitudinal edge is positioned at a second particular length from the front end; and the second particular length is about one-half a distance from the front end to a second end.

13. The chair of claim 9, further comprising:

a plurality of seat depressions in the upper surface in a first pattern; and a plurality of receiving portion depressions in a receiving portion surface of the receiving portion in a second pattern, wherein the second pattern is similar to the first pattern.

14. The chair of claim 13, wherein the upper surface includes an area in which one or more seat depressions are omitted from the first pattern in which the plurality of seat depressions is arranged.

15. The chair as in claim 9, wherein:

the receiving portion is disposed in between about five percent (5%) and about twenty percent (20%) of the upper surface and the padding layer covers more than eighty percent (80%) of the upper surface;

the receiving portion is disposed in between about five percent (5%) and about fifteen percent (15%) of the upper surface and the padding layer covers more than eighty-five percent (85%) of the upper surface of the seat;

the receiving portion is disposed in between about five percent (5%) and about ten percent (10%) of the upper surface and the padding layer covers more than ninety percent (90%) of the upper surface of the seat;

the receiving portion is disposed in between about five percent (5%) and about twenty percent (20%) of the upper surface and the padding layer covers more than ninety percent (90%) of the upper surface of the seat;

the receiving portion is disposed in between about five percent (5%) and about fifteen percent (15%) of the upper surface and the padding layer covers more than ninety percent (90%) of the upper surface; or the receiving portion is disposed in between about five percent (5%) and about ten percent (10%) of the upper surface and the padding layer covers more than ninety percent (90%) of the upper surface.

16. The chair as in claim 9, wherein the depth of the receiving portion corresponds to a thickness of the padding material such that when the padding material is disposed in the receiving portion, a top surface of the padding material is generally aligned with the upper surface of the seat base.

17. A seat base constructed of a blow-molded plastic, the seat base comprising:

an upper surface including a left side, a right side, a front end, and a rear end;

a receiving portion integrally formed as part of a unitary, one-piece construction in the upper surface, the receiving portion having a left lateral edge, a right lateral edge, a front longitudinal edge, a rear longitudinal edge, and a depth;

wherein:

the left lateral edge is oriented in a direction of the left side;

the right lateral edge is oriented in a direction of the right side;

the front longitudinal edge is oriented in a direction of the front end;

the rear longitudinal edge is oriented in a direction of the rear end;

the receiving portion is defined in about twenty-five percent (25%), about twenty percent (20%), about fifteen percent (15%), about ten percent (10%), or about five percent (5%) of the upper surface; and the receiving portion is positioned on the upper surface such that:

the first particular length falls within the left lateral edge and the right lateral edge;

a centerline of the seat base approximately bisects the front longitudinal edge and the rear longitudinal edge;

the front longitudinal edge is positioned at a second particular length from the front end; and the second particular length is about one-half a distance from the front end to a second end.

18. The seat base as in claim 17, wherein the seat base is configured to be pivotally coupled to a frame at a first particular length from the front side.

19. The seat base as in claim 17, further comprising:

a plurality of seat depressions in the upper surface in a first pattern;

a plurality of receiving portion depressions in a receiving portion surface of the receiving portion in a second pattern;

a central channel in the upper surface, the central channel being oriented along a centerline of the seat base; and one or more rib channels in the upper surface that extend from an outer portion of the seat base to the central channel.

* * * * *